US006541985B2

(12) United States Patent
Yankielun

(10) Patent No.: US 6,541,985 B2
(45) Date of Patent: Apr. 1, 2003

(54) SYSTEM AND METHOD FOR REMOTELY MONITORING AN INTERFACE BETWEEN DISSIMILAR MATERIALS

(75) Inventor: Norbert E. Yankielun, Lebanon, NH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 7 days.

(21) Appl. No.: 09/879,001

(22) Filed: Jun. 13, 2001

(65) Prior Publication Data

US 2002/0190726 A1 Dec. 19, 2002

(51) Int. Cl.[7] ..... G01R 27/04; G01R 31/11; G01V 3/08

(52) U.S. Cl. ..... 324/644; 324/534; 324/326

(58) Field of Search ..... 324/644, 642, 324/643, 532, 533, 534, 535, 536, 539, 543, 540

(56) References Cited

U.S. PATENT DOCUMENTS 5,608,328 A * 3/1997 Sanderson ..... 324/133
5,726,578 A 3/1998 Hook ..... 324/643
5,784,338 A 7/1998 Yankielun ..... 367/131
5,841,289 A 11/1998 Yankielun ..... 324/639
5,898,308 A * 4/1999 Champion ..... 324/642
5,900,820 A 5/1999 Yankielun ..... 340/580
6,084,393 A 7/2000 Yankielun ..... 324/72.5
6,100,700 A 8/2000 Yankielun ..... 324/534
6,121,780 A * 9/2000 Cruickshank et al. ..... 324/637

* cited by examiner

*Primary Examiner*—Christine K Oda
*Assistant Examiner*—James Kerveros
(74) *Attorney, Agent, or Firm*—Earl H. Baugher, Jr.

(57) ABSTRACT

A system for efficiently and cost effectively monitoring the status of the interface between two dissimilar media is provided. In a preferred embodiment, the system uses principles applied from the theory of time domain reflectometry (TDR), together with novel circuitry and low cost narrow band telemetry, to provide real time monitoring on a continuous basis, as needed. The circuitry involved permits operation of the system without relying on relative values of signal amplitude while employing a novel feedback function that sets the pulse repetition frequency instantaneously to permit an optimum data collection rate as well as a separate measure of the status based on the system operating parameters. It has particular application to real time monitoring and alerting to the effect of scour events in waterways.

26 Claims, 2 Drawing Sheets

SYSTEM AND METHOD FOR REMOTELY MONITORING AN INTERFACE BETWEEN DISSIMILAR MATERIALS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to sensing, monitoring and alerting functions. In particular, it employs novel electronic circuits to detect, monitor and alert to a present condition based on the location of the interface between materials having different coefficients of refraction, such as may occur typically at the interface between water in a stream and sediments thereunder during a scour event.

2. Description of the Prior Art

Scour is a severe problem that results in millions of dollars of damage to infrastructure and substantial loss of life annually. Scour occurs during times of high tides, hurricanes, rapid river flow, and icing conditions, when sediment, including rocks, gravel, sand, and silt, are transported by currents, undermining bridge and pier foundations, submarine utility cables, and pipelines, and filling in navigational channels. Scour is dynamic; ablation and deposition can occur during the same high-energy hydrodynamic event. The net effect of scour has not been easily predicted, nor readily monitored, in real-time heretofore.

Bridge scour monitoring technologies are known. In U.S. Pat. No. 5,784,338, issued Jul. 21, 1998 to Norbert E. Yankielun et al, an instrument called a "time domain reflectomer" (TDR) is directly connected to a parallel transmission line consisting of a pair of robust, specially fabricated non-corroding rods or wires (hereinafter "leads"). The principle of TDR is generally known, described in the technical literature, and applied to numerous measurements and testing applications. The technique was applied to scour detection and monitoring in the aforesaid '338 patent, which is incorporated herein by reference. TDR operates by generating an electromagnetic pulse, or a fast rise time step, and coupling it to a transmission line. The pulse travels down the transmission line at a fixed and calculable velocity, a function of the speed of light and the electrical and physical characteristics of the transmission line. The pulse propagates down the transmission line until the end of the line is reached, and is then reflected back toward the source. The time in seconds that it takes for the pulse to propagate down and back the length of the transmission line is called the "round trip travel time" and is calculated as described in the '338 patent. For a two-wire parallel transmission line, changes in the dielectric media in the immediate surrounding volume cause a change in the roundtrip travel time of a pulse initiated thereon. Further, at any boundary between differing media located along the transmission line (e.g., air/water, water/sediment, etc.) a discontinuity exists that is characterized by a change in the refractive index from one medium to the next. As a pulse imposed on the transmission line encounters these boundaries, a portion of the pulse is reflected back to its source. The remaining portion of the pulse continues on to encounter other boundaries with like results, or the end of the transmission line from which it is reflected, in whole or part, back to its source. Measuring the time of flight of the reflected pulse(s), while knowing the refractive index of the media through which it passes enables one to determine where along the transmission line these boundaries are Freshwater has a relatively high dielectric constant and dry sedimentary materials (e.g.: soil, gravel and stone) have a relatively low dielectric constant. Wet sediment has a dielectric constant that is a mixture of the constants of water and dry soil. The dielectric constant of this mixture will vary, depending upon the local sedimentary material constituency. However, in all cases of bulk dielectric, the bulk index of refraction of the mixture will be less than that of liquid water alone and significantly greater than that of the dry sedimentary materials. Some sediment materials, particularly clay-based sediments, can be extremely "lossy". This lossy behavior of the soil is exhibited by a severe attenuation of an electromagnetic pulse as it propagates along a transmission line surrounded by such materials. The pulse, when launched from a TDR, dissipates as it travels along the transmission line. Sufficient dissipation reduces the reflected pulse energy below a detectable level. For lossy consolidated soils, such as clay, the electromagnetic signal is attenuated greatly as it propagates along transmission line leads embedded in these soils. Levels of signal attenuation may be as great as tens of dBs/m in clay, yielding undetectable reflected signals in some cases. To protect the transceiver from scour action in a stream, it may be beneficial to bury it in the sediment below the expected level of scour. In this scenario, the soil, typically clay, may absorb all or most of a pulse's energy, some on transmission, and the rest on reflection. For the case in which the transceiver is located in the water above the sediment, a pulse will be minimally attenuated in the water and will reflect strongly from the boundary with the sediment, the sediment having a significantly different refractive index. This occurs because the amplitude of the reflection correlates directly to the ratio between the refractive indices at the boundary.

In either of the above scenarios, once a portion of the transmitted pulse is reflected from the water/sediment boundary, the remainder of the pulse propagates to the end of the transmission line leads whereupon it also is reflected. If the reflection from the water sediment/boundary is difficult to detect, the reflection of its complement that must traverse the entire distance of the transmission line will be even more difficult to detect. Discernment of the occurrence of these two significant events thus complicates the problem of identifying a location at which scour in a streambed is occurring, for example.

Thus, needed is a real time scour detection and monitoring system that uses information gleaned from its own operation to set optimal operating parameters for purposes of establishing reflected signals that are able to be differentiated. Further, this system should be both operationally and fiscally efficient, able to broadcast continuous data, if need be, in real time using inexpensive narrow-bandwidth transmitters and data processors.

SUMMARY OF THE INVENTION

A system for efficiently and cost effectively monitoring the status of the interface between two dissimilar media is provided. The system uses principles applied from the theory of time domain reflectometry (TDR), together with novel circuitry and low cost narrow band telemetry, to provide real time monitoring on a continuous basis, as needed.

In a preferred embodiment, a system employing TDR techniques using a pulsed signal generator but having novel circuitry unique to this invention, is emplaced in an environment that permits access to a boundary between one media and a second media of interest. This may be, e.g., a streambed in which the first media is water and the media of interest is the sediment thereunder. Using basic principles of TDR, an electromagnetic pulse is imposed on parallel transmission lines embedded so as to traverse portions of both media, traversal through the interface therebetween being of most importance. The time of travel of this pulse to a first boundary, that is ostensibly the boundary of interest, is used in a feedback line to establish the pulse repetition frequency of operation of the pulse generator of the system via operation of a portion of the circuitry that is unique to this invention. The reflected pulse is also provided to a signal processing circuit that prepares the pulse for transmission on a low cost narrowband telemetry system.

DESCRIPTION OF THE PREFERRED EMBODIMENTS

Figure 1:
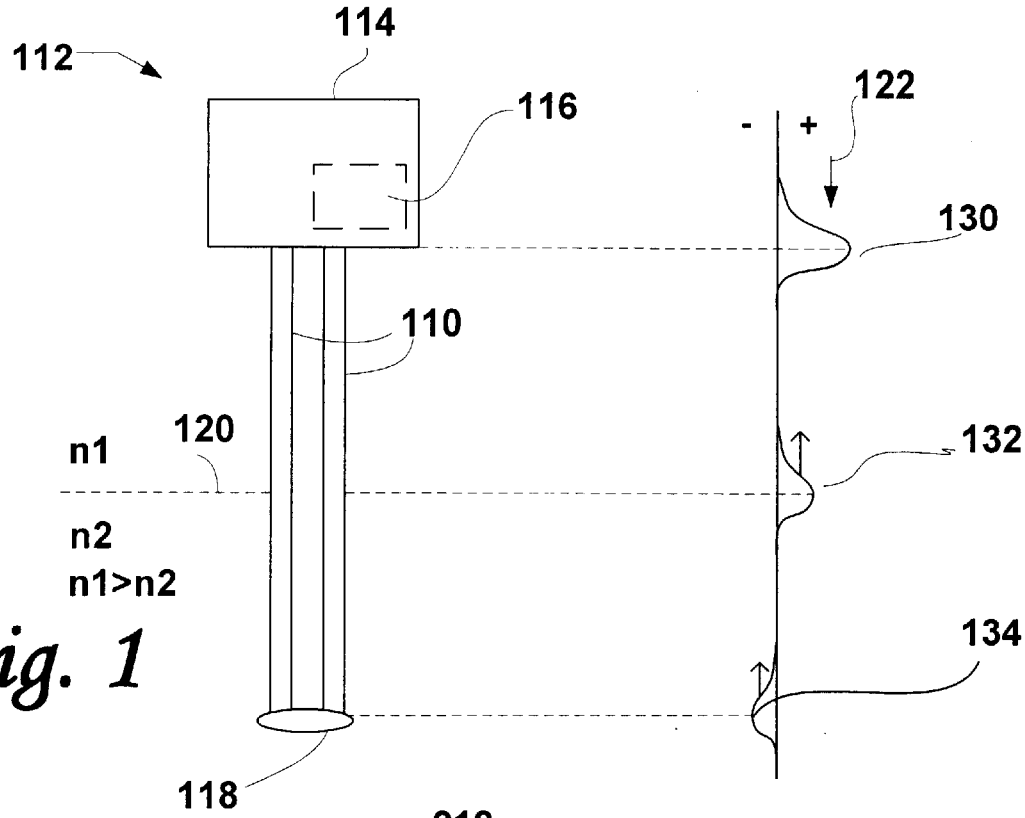
FIG. 1 is a side view of a preferred embodiment of the present invention as installed to monitor a boundary between differing media together with relative amplitude and polarity of representative pulses appearing on a transmission line thereof.

Refer to FIG. 1. A boundary monitoring system 112 of the present invention is shown emplaced such that an electronics package 114, including a pulse generator circuit 116 employing TDR techniques internal thereto, are located at an uppermost position with respect to the generally parallel transmission line leads 110 to be pulsed via connection with the pulse generator circuit 116. In a more permanent installation, the electronics package 114 may be powered via an external source, preferably a DC power supply, connected via a cable to the electronics package 114. Neither the source nor cable is separately shown.

As depicted, the boundary 120 of interest includes a first media having a refractive index, $n_1$, and a second media having a refractive index, $n_2$, where $n_1>n_2$. In operation, a transmitted pulse 130, that may be of positive polarity as depicted, is imposed on the transmission line leads 110 in the direction indicated by the arrow 122. At the boundary 120, a portion 132 of the transmitted pulse 130, is reflected back towards the source, i.e., the pulse generator circuit 116. The remainder (not separately shown) of the transmitted pulse 132 continues along the transmission line leads 110 to the termination 118 thereof. Depicted in FIG. 1 is a short circuit termination 118. At the termination 118, this remainder portion is reflected back, in whole or in part, as depicted by the reflected pulse 134 of opposite polarity. Note that as the pulse travels further along the transmission line leads 110 and encounters media of a smaller refractive index, because a portion of the transmitted pulse has already been reflected and then enters a media having a lower refractive index, $n_2$, the reflected pulse 134 is attenuated significantly as shown by comparing the amplitude of the reflected pulse 134 from the termination 118 with that of the reflected pulse 132 from the boundary 120. In some cases the reflected pulse 134 from the termination 118 may not be detectable by a standard detector.

Figure 2:
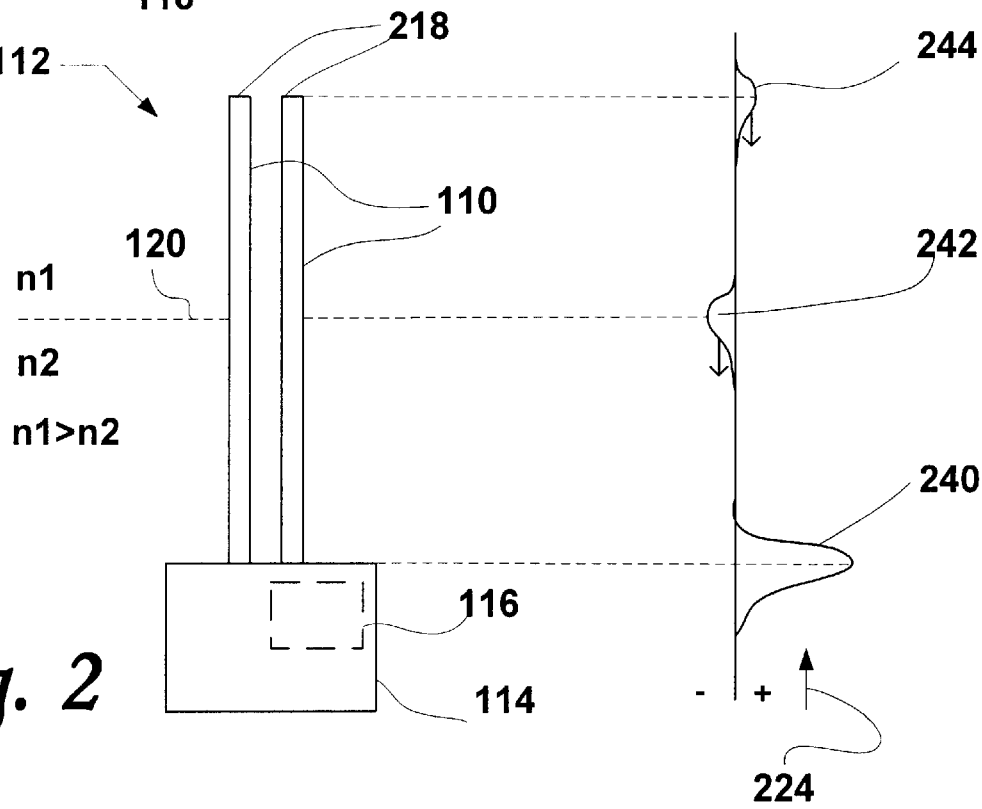
FIG. 2 is a side view of the embodiment of FIG. 1 inverted in a similar installation.

Refer to FIGS. 1 and 2. The transmission line leads 110, comprising wires or rods as used in a system for monitoring scour in a streambed or along a shoreline, may be approximately 1–2 meters (3–6 ft) in length. The diameter of the wire or rods 110, nominally approximately 1.6–3.2 mm (1/16–1/8), as well as spacing thereof, may be selected to achieve an impedance match with a first media into which the leads 110 of the system 112 are installed. As is seen by comparing FIGS. 1 and 2, this first media may be either that comprising the greater refractive index, $n_1$, as in FIG. 1 or that of the lesser refractive index, $n_2$, as shown in FIG. 2. The leads 110 may be terminated in a short circuit 118 as indicated in FIG. 1 or have an open circuited termination 218 as shown in FIG. 2. An open-circuited transmission line results in a reflected pulse 244 at its termination 218 of the same polarity as is transmitted whereas a short-circuited transmission line, as depicted in FIG. 1, reverses the polarity of the reflected pulse 134 at its termination 118.

In FIG. 2, note that because the transmitted pulse 240 initiated in the direction indicated by the arrow 224 first traverses media having a refractive index, $n_2$, then encounters a boundary of media having a refractive index, $n_1$, where $n_1>n_2$, the reflected pulse 242 from the boundary 120 is reversed in polarity. This fact is key in designing installations of the present invention. Also note that the relative amplitude of the initiating pulse 240 of FIG. 2 is shown as being greater than that of the initiating pulse 130 of FIG. 1 while that of the reflected pulse 242 from the boundary 120 is less than that of the reflected pulse 132 of FIG. 1. This pictorially conveys the significant attenuation encountered when a preferred embodiment of the present invention is installed so that the transmission line's "transmitting end" is installed in media having a relatively low refractive index, $n_2$.

The amplitude of a reflected pulse 132, 134, 242, 244 reflected from a boundary 120 between media having refractive indices of $n_1$ and $n_2$, respectively, is proportional to a reflection coefficient, ρ, given by:

$$\rho = \frac{(n_1 - n_2)}{(n_1 + n_2)} \tag{1}$$

such that Eon. (1) describes the reflection coefficient of the configuration of FIG. 1, since the first media encountered by the transmitted pulse 130 is that with the refractive index $n_1$. Substituting $n_2$ for $n_1$ and vice versa in Eon. (1) yields the reflection coefficient for the configuration of FIG. 2. Thus, since $n_1>n_2$, ρ is positive for the configuration of FIG. 1 and negative for the configuration of FIG. 2. The reflected pulse 132 at the boundary 120 for the configuration of FIG. 1 is thus positive polarity while the reflected pulse 242 at the boundary 120 of the configuration of FIG. 2 reverses polarity to the negative.

For either configuration represented in FIGS. 1 and 2, the terminal reflected pulses 134, 244 are of opposite polarity to their respective "boundary reflected" pulses 132, 242. This phenomenon is useful in designing a simple circuit to make use of this difference in polarity so that even relative amplitude does not have to be determined or employed. It is particularly useful in those cases where pulse amplitude of these reflected pulses 132, 134, 242, 244 may be severely attenuated by passing through, not once, but twice, media having a relatively low refraction coefficient. Thus, the difficulty induced in having to detect low amplitude signals due to significant signal attenuation has been removed if one deals only in ascertaining the polarity of the reflected pulses 132,134,242,244.

Either the configuration of FIG. 1 or FIG. 2 may be used to determine the location of the boundary 120, such as a water/sediment boundary at a pre-specified location in a streambed, while monitoring and alerting to changes therein in real time. Although either configuration represented by FIGS. 1 and 2 may be suitable for operation with the present invention, the configuration of FIG. 1 is preferred because of the greater relative amplitude levels available in the reflected pulses 132, 134. This inherent capability of the configuration of FIG. 1 also means that the transmit pulse imposed on the transmission line leads 110 may be of lower amplitude than that of the configuration of FIG. 2 to achieve a minimally discernible signal with a low cost detector while requiring less energy to power and a concomitant smaller physical embodiment to achieve its function.

Figure 3:
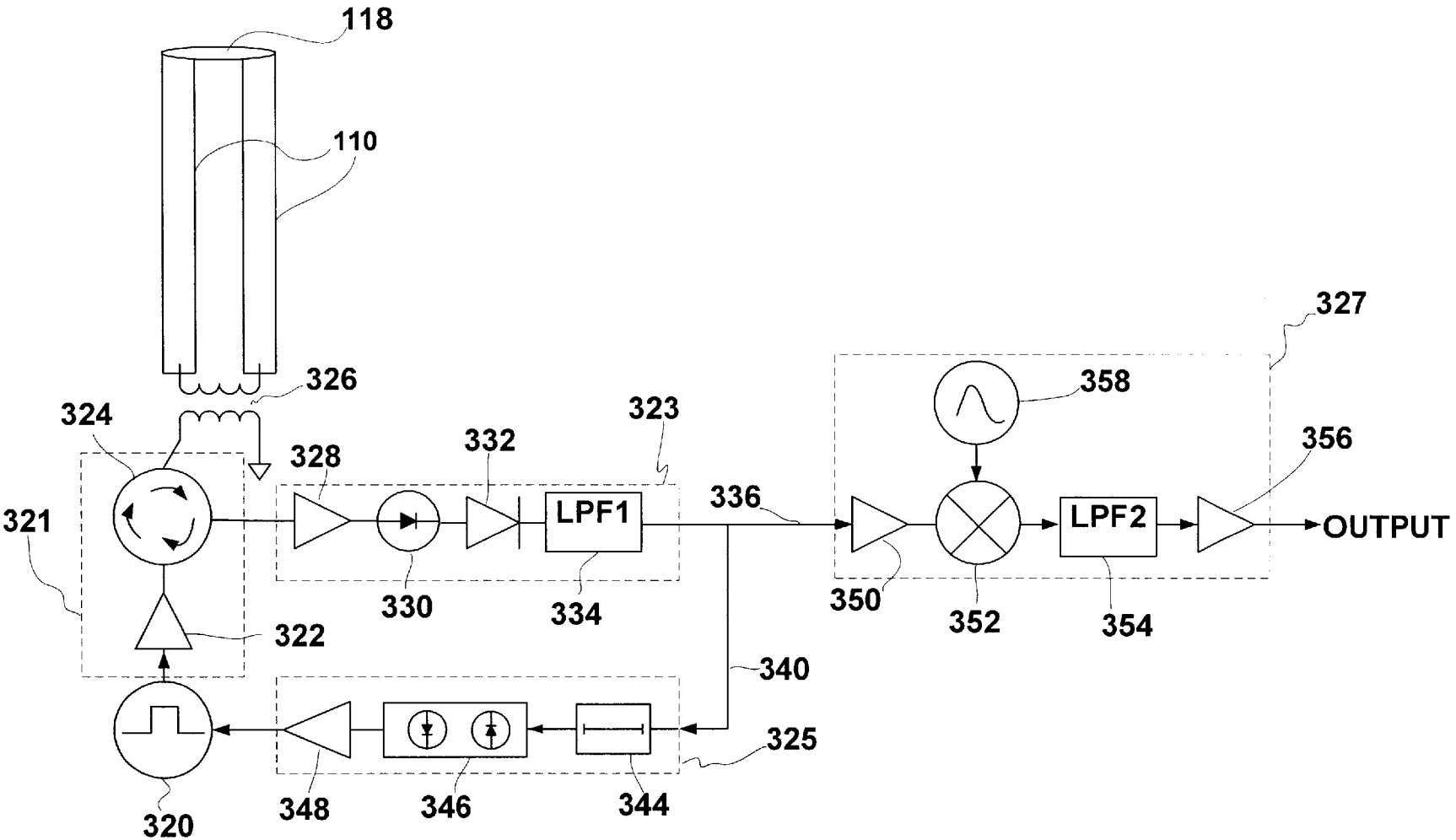
FIG. 3 depicts representative circuitry associated with a preferred embodiment of the present invention as connected to the transmission line leads via an impedance matching transformer.

Refer to FIG. 3. A pulse generator 320, capable of being triggered in real time, generates a narrow pulse that may be conditioned in a first conditioning circuit 321 where it may be amplified as needed for a specific application by an amplifier 322. A pulse thus generated is provided to a circulator 324 or Tee (not separately shown). From the circulator 324, the pulse is provided to an impedance matching transformer 326, if needed. This impedance matching transformer 326 may be designed with an impedance ratio that assures that "boundary reflected" pulses 132, 242 will have either the same polarity of the transmitted pulses 130, 240, i.e., the configuration of FIG. 1, or the reverse polarity, i.e., the configuration of FIG. 2. In some applications an impedance matching transformer may not be needed so that the physical configuration of the transmission leads 110 may be set to match the expected impedance of the environment into which it is inserted given that the environment maintains relatively constant impedance. As required for a specific application, the impedance matching transformer 326 permits the impedance of the circuit 321 to approximate that of the media, e.g., water or sediment for an in-stream installation, that will initially surround the "transmitter ends" of the transmission line leads 110. Once imposed on the transmission line leads 110, the pulse traverses the length of the leads 110, reflecting at least in part from any boundary 120 and in whole or part from the termination 118, 218 of the leads 110. Upon reflection, the individual reflected pulses 132, 134, 242, 244 re-enter the impedance matching transformer 326 (if present), are blocked from returning to the pulse generator 320 by the circulator 324 and thus encounter a second conditioning and selection circuit 323 incorporating an amplifier 328, where they are amplified to a usable level prior to being provided to a half-wave rectifier 330. It is within the half-wave rectifier 330 that a first novel implementation of the present invention occurs. The half-wave rectifier 330 is configured to pass only the reflected pulses 132, 242 from the boundary 120, thus its polarity is chosen to match whatever configuration in which the system 112 is installed, i.e., only a positive polarity pulse 132 would be processed for the configuration of FIG. 1 and only a negative polarity pulse 242 for the configuration of FIG. 2. The relative amplitude of these pulses 132, 242 is immaterial, it being necessary only for them to be sufficient amplitude for use by the half-wave rectifier 330. The "boundary reflected" pulse 132, 242 is then provided to a first inverting amplifier 332 where its polarity is reversed and then on to a first low pass filter (LPF1) 334. The LPF 334 removes the DC component of the signal and provides a "cleaner" pulse 132, 242 for further use.

The half-rectified pulse 132, 242 is then provided for further processing along two paths 336, 340. The first 336 inputs to an output circuit 327 providing the system 112 output while the second 340 inputs to a feedback circuit 325. Feedback may be initialized through an optional time delay device 344, generating a time delay, $\tau$, that may be used to establish a minimum pulse repetition frequency (prf) to cycle the transmitted pulses 130, 240. Once the delay, $\tau$, has been imposed on the conditioned half-rectified pulse 132, 242, it is provided to a diode limiter 346 for further conditioning. The pulse 132, 242 is configured to have a steep rise time and a "flat top" suitable for use as a trigger pulse. It is then amplified by a third amplifier 348 for use as a trigger pulse to the pulse generator 320. Thus, a trigger pulse is initiated at the pulse generator 320 based on an interval of time required for a transmitted pulse 130, 240 to travel to the boundary 120 of interest and return as "boundary reflected" pulses 132, 242 to the amplifier 348 providing the trigger pulse. This "roundtrip time" (and its inverse, the prf of the transmitted pulses 130, 240) will vary with the position of the boundary 120, thus the instantaneous prf of the transmitted signal 130, 240 provides information that may be translated to a distance value suitable for use in real time monitoring, such as for determining the level of scour in a streambed. Thus, by monitoring the operating parameters of the pulse generator 320, one may glean useful, precise, time-critical information on occurrences being observed with the sensor system 112. Further, since it is performed in real time, it provides other useful information, such as the instantaneous rate of scour, so that it may be used for predicting events, taking preventive action, and issuing timely warnings.

The output of the system is provided via an output circuit 327 by amplifying, via a fourth amplifier 350, the conditioned half-rectified pulse 132, 242. The amplified conditioned half-rectified pulse is then provided to a mixer 352 where it is mixed with a signal from a local oscillator (LO) 358. The operating frequency of the LO 358 is chosen to correlate to that of the prf of the system 112, generating a frequency difference within the mixer 352 suitable for creating a signal of narrow bandwidth for transmission via a cable (not separately shown) or a low cost telemetry system (not separately shown). This signal is then provided to a second low pass filter (LPF2) 354 to remove any high frequency elements and amplified by a fifth amplifier 356 prior to being output for transmission to a remote location for its ultimate use.

A cable-based system 112 based on TDR principles may be used for long term or permanent monitoring scenarios in which an umbilical, low-loss coaxial cable (not separately shown) is easily installed in a permanent configuration. This configuration implies a physically short distance, typically a few hundred feet, between the leads 110 and the pulse generator 320. An implementation using batteries (not separately shown) and a wireless communications device (not separately shown), or submerged acoustic telemetry link (not separately shown), may be used in temporary installations in which the sensor system 112 is retrieved periodically for replacement of batteries and refurbishing as needed.

Refer to FIGS. 1 and 2. In a practical installation, a preferred embodiment of the present invention, e.g., a scour sensor system 112, is buried in river bottom sediments having a refraction coefficient, $n_2$, and anchored (not separately shown) at a point below the maximum expected depth of scour. For low-loss sediments, the sensor system 112 may be installed with the electronics package 114 buried deeply in the sediment as shown in FIG. 2, thus providing some protection from scouring action for the electronics package 114. In those cases where the sediment is consolidated soil, such as clay, the attenuation of the pulsed signal may be severe. For this scenario, the configuration of FIG. 1 is preferred, although some risk of damage to the electronics package 114 from scour events is unavoidable.

A preferred embodiment of the present invention may be installed in a streambed or at other water/sediment interfaces by "air jetting" or "hydro-jetting." In soft sediment, it may be installed by "pile driving" it in or hydraulically forcing it into the sediment. Once emplaced, the top of the sensor system 112 is "surveyed in" relative to a local survey benchmark (not separately shown) to permit ready identification of the geographic location being monitored.

After emplacement of the system 112 in a streambed or other waterway, an initial reference level is established for the response of the sensor system 112 to an imposed (transmitted) pulse 130, 240, thus establishing an initial location for the water/sediment boundary 120. This is done by determining the travel time for a boundary reflected pulse 132, 242 to return as well as the roundtrip time for a transmitted pulse 130, 240 imposed on the leads 110 to traverse to the termination 118, 218 and return to the source 116. This roundtrip time may be used to assist in calibrating the sensor system 112 and the travel time of the boundary reflected pulse 132, 242 is used for initializing the feedback 325 and output 327 circuitry. This information is stored in a suitable storage device such as a computer (not separately shown).

Responses received during subsequent operation of the system 112 are acquired, processed, and compared with the stored reference data. A computer algorithm, operated in real time, may be used to compare the reference values with real time data and trigger an alarm when a pre-specified threshold has been exceeded. In one embodiment, output of the sensor system 112 may be multiplexed with signals from other sensor systems 112 that may be used in an array (not separately shown) to monitor the foundation of a structure or sediment field of interest.

It is to be understood that the present invention is by no means limited to the particular constructions herein disclosed and/or shown in the drawings, but also comprises any modification or equivalent within the scope of the claims.

What is claimed is:

1. A system that facilitates remote monitoring of at least one interface between media having dissimilar refraction coefficients, $n_1$ and $n_2$, $n_1>n_2$, comprising:

a signal generator for generating at least one pulse of electromagnetic energy;

a first conditioning circuit in operable communication with said signal generator;

a transmission line, having a transmitter end and a termination end, in operable communication with said first conditioning circuit, said transmission line suitable for conveying said at least one pulse of electromagnetic energy and reflected pulses of said at least one pulse from said at least one interface and said termination end, wherein if said transmitter end is appurtenant media with a refraction coefficient $n_1$, said termination end is electrically shorted, and wherein if said transmitter end is appurtenant media with a refraction coefficient $n_2$, said termination end is electrically open;

a selection and conditioning circuit in operable communication with said transmission line, wherein said selection and conditioning circuit enables throughput of only those said reflected pulses of a pre-specified class;

a feedback circuit in operable communication with said selection and conditioning circuit and said pulse generator, wherein said feedback circuit establishes at least one operating parameter of said system; and an output circuit in operable communication with said selection and conditioning circuit, wherein said output circuit permits transmission of at least one output signal from said system over means having a narrow frequency bandwidth.

2. The system of claim 1 further comprising an impedance matching transformer interposed said first conditioning circuit and said transmission line, and in operable communication with each.

3. The system of claim 1 in which said feedback circuit conditions said at least one reflected pulse of a pre-specified class resultant from said conditioning and selection circuit for use as a trigger pulse to initiate further said at least one generated pulses, wherein, upon initiation of system operation, said trigger pulse is thus provided at a variable pulse repetition frequency (prf) suitable for determining an instantaneous relative position of at least one said interface from which said at least one generated pulse reflects.

4. The system of claim 1 further comprising an impedance matching transformer in operable communication with said transmission line, said first conditioning circuit and said conditioning and selection circuit.

5. The system of claim 1 in which said pre-specified class is one of the two classes characterizing the polarity of said reflected pulses.

6. The system of claim 1 in which said first conditioning circuit amplifies said generated pulse and provides a one-way path for conveying said generated pulse to said transmission line.

7. The system of claim 1 in which said transmission line comprises parallel conductors having a length much greater than any other dimension, each with a transmitter end and a termination end, wherein said parallel conductors are sized and spaced apart to permit impedance matching the impedance of media in the environment appurtenant said transmitter end as emplaced for operation.

8. The system of claim 1 in which said first conditioning circuit comprises:

a first amplifier in operable communication with said pulse generator; and a circulator in operable communication with said amplifier in operable communication with said pulse generator.

9. The system of claim 8 further comprising an impedance transformer in operable communication with said circulator and said transmission line.

10. The system of claim 1 in which said selection and conditioning circuit comprises:

a second amplifier in operable communication with said transmission line;

a half-wave rectifier in operable communication with said first amplifier;

an inverting amplifier in operable communication with said half-wave rectifier; and a first low pass filter.

11. The system of claim 1 in which said feedback circuit comprises:

a time delay device in operable communication with said selection and conditioning circuit;

a diode limiter in operable communication with said time delay device;

and a third amplifier in operable communication with said diode limiter and said pulse generator.

12. The system of claim 1 in which said output circuit comprises:

a fourth amplifier in operable communication with said selection and conditioning circuit;

a mixer in operable communication with said amplifier;

a local oscillator in operable communication with said mixer;

a second low pass filter in operable communication with said mixer; and a fifth amplifier in operable communication with said second low pass filter.

13. The system of claim 1 further comprising a telemetry system for transmitting said output of said output circuit.

14. The system of claim 1 further comprising a cable for transmitting said output of said output circuit.

15. The system of claim 1 further comprising a cable for providing power to said system.

16. The system of claim 15 in which said power is provided as DC power.

17. The system of claim 1 further comprising batteries co-located with said system to power said system.

18. The system of claim 1 further comprising at least one computer for processing, storing and manipulating said output from said system, wherein said computer facilitates achieving said system's monitoring and alerting functions.

19. The system of claim 1 further comprising an operable connection to at least one multiplexer from said output circuit, said multiplexer provided for communicating output from multiple said systems.

20. A method that facilitates remote monitoring of at least one interface between media having dissimilar refraction coefficients, $n_1$ and $n_2$, $n_1>n_2$, comprising:

emplacing a transmission line in operable communication with said interface, said transmission line having a transmitter end and a termination end, wherein said transmission line is suitable for conveying at least one imposed pulse of electromagnetic energy and at least one reflected pulse of said at least one imposed pulse from said at least one interface and said termination end, wherein if said transmitter end is appurtenant media with a refraction coefficient, $n_1$, said termination end is electrically shorted, and wherein if said transmitter end is appurtenant media with a refraction coefficient, $n_2$, said termination end is electrically open;

generating at least one pulse of electromagnetic energy;

imposing said at least one generated pulse of electromagnetic energy on said transmission line;

capturing at least one reflection of said generated pulse as at least one reflected pulse;

selecting for further processing only those said at least one reflected pulses representing a pre-specified class; and processing said selected at least one reflected pulses to condition said selected reflected pulses to facilitate said remote monitoring.

21. The method of claim 20 further comprising amplifying said generated pulse and providing a one-way path for conveying said generated pulse to said transmission line.

22. The method of claim 20 further comprising facilitating an impedance match with said media appurtenant said transmitter end of said transmission line.

23. The method of claim 22 further comprising providing an impedance matching transformer at said transmitter end of said transmission line.

24. The method of claim 20 in which said pre-specified class is one of the two classes characterizing the polarity of said at least one reflected pulses.

25. The method of claim 20 further comprising:

conditioning said selected reflected pulses of a pre-specified class; and employing said selected reflected pulses of a pre-specified class as a trigger pulse to generate further said at least one generated pulses of electromagnetic energy;

wherein said conditioning of said selected reflected pulses of a pre-specified class establishes at least one operating parameter of said system, and wherein, upon initiation of system operation, said trigger pulse is thus provided at a variable pulse repetition frequency (prf) suitable for determining an instantaneous relative position of at least one said interface from which said at least one generated pulse reflects.

26. The method of claim 20 further conditioning said selected reflected pulses of a pre-specified class to permit transmission of at least one output signal from said system over means having a narrow frequency bandwidth.

* * * * *